US009714459B2

(12) United States Patent
Inoue et al.

(10) Patent No.: US 9,714,459 B2
(45) Date of Patent: Jul. 25, 2017

(54) HEAT-RESISTANT AUSTENITIC STAINLESS STEEL SHEET

(71) Applicant: NIPPON STEEL & SUMIKIN STAINLESS STEEL CORPORATION, Tokyo (JP)

(72) Inventors: Yoshiharu Inoue, Tokyo (JP); Fumio Fudanoki, Tokyo (JP); Junichi Hamada, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 308 days.

(21) Appl. No.: 14/387,114

(22) PCT Filed: Mar. 28, 2013

(86) PCT No.: PCT/JP2013/059274

§ 371 (c)(1),
(2) Date: Sep. 22, 2014

(87) PCT Pub. No.: WO2013/147027

PCT Pub. Date: Oct. 3, 2013

(65) Prior Publication Data

US 2015/0083283 A1 Mar. 26, 2015

(30) Foreign Application Priority Data

Mar. 30, 2012 (JP) ..... 2012-082114

(51) Int. Cl.

| | |
|---|---|
| ***C22C 38/58*** | (2006.01) |
| ***C21D 9/46*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C21D 1/26*** | (2006.01) |
| ***C21D 8/02*** | (2006.01) |

(52) U.S. Cl.

CPC ..... *C22C 38/58* (2013.01); *C21D 6/004* (2013.01); *C21D 9/46* (2013.01); *C22C 38/001* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 1/26* (2013.01); *C21D 8/0236* (2013.01); *C21D 8/0263* (2013.01); *C21D 2211/001* (2013.01); *C21D 2211/004* (2013.01)

(58) Field of Classification Search

CPC ..... C22C 38/001; C22C 38/02; C22C 38/04; C22C 38/06; C22C 38/42; C22C 38/44; C22C 38/46; C22C 38/48; C22C 38/50; C22C 38/52; C22C 38/54; C22C 38/58; C21D 1/26; C21D 6/004; C21D 8/0236; C21D 8/0263; C21D 9/46; C21D 2211/001; C21D 2211/004

See application file for complete search history.

(56) References Cited

U.S. PATENT DOCUMENTS

| | | | |
|---|---|---|---|
| 4,581,067 | A | 4/1986 | Iijima et al. |
| 2006/0193743 | A1 | 8/2006 | Semba et al. |
| 2008/0089803 | A1 | 4/2008 | Okada et al. |
| 2010/0034689 | A1 | 2/2010 | Hirata et al. |
| 2010/0054983 | A1 | 3/2010 | Osuki et al. |

FOREIGN PATENT DOCUMENTS

| | | | |
|---|---|---|---|
| CN | 1833043 | A | 9/2006 |
| EP | 0 178 374 | A1 | 4/1986 |
| EP | 0 780 483 | A1 | 6/1997 |
| EP | 1 471 158 | A1 | 10/2004 |
| JP | 59-080757 | A | 5/1984 |
| JP | 62-243742 | A | 10/1987 |
| JP | 07-316653 | A | 12/1995 |
| JP | 09-228003 | A | 9/1997 |

(Continued)

OTHER PUBLICATIONS

Guthrie et al., "Processing of Solid Steel", ASM Handbook, 1990, ASM International, vol. 1, p. 1-13.*

Hudson, R.M., "Pickling and Descaling", ASM Handbook, 1994, ASM International, vol. 5, p. 1-5.*

International Search Report issued in PCT/JP2013/059274 dated Jun. 11, 2013.

*Primary Examiner* — Roy King
*Assistant Examiner* — Caitlin Kiechle
(74) *Attorney, Agent, or Firm* — Birch, Stewart, Kolasch & Birch, LLP

(57) ABSTRACT

The present invention is directed to a heat-resistant austenitic stainless steel sheet comprising, by mass %, C: 0.03% to 0.06%, N: 0.1% to 0.3%, Si: 1% or less Mn: 3% or less, P: 0.04% or less, S: 0.03% or less, Ni: 5 to 12%, Cr: 15 to 20%, Al: 0.01% to 0.1%, Nb: 0.05% to 0.3%, V: 0.05% to 0.30%, Ti: 0.03% or less, (Nb+V)/(C+N): 2 or less and further a balance of Fe and unavoidable impurities, and wherein an amount of precipitates mainly comprised of carbonitrides is 1% or less.

4 Claims, No Drawings

(56) References Cited

FOREIGN PATENT DOCUMENTS

| | | | |
|---|---|---|---|
| JP | 2005-105357 | A | 4/2005 |
| JP | 2009-030128 | A | 2/2009 |
| JP | 2012-001749 | A | 1/2012 |

* cited by examiner

HEAT-RESISTANT AUSTENITIC STAINLESS STEEL SHEET

TECHNICAL FIELD

The present invention relates to heat-resistant austenitic stainless steel which is used for a portion which is exposed to a high temperature such as a automotive turbo housing and to a method of production of the same.

BACKGROUND ART

In the past, the material which has been used for the automotive turbo housing etc. has been required to exhibit an extremely high-temperature strength under a high-temperature environment which reaches as much as 800° C., so stainless cast steel has been used. However, in the face of the demand for reducing costs in recent years, production of parts from steel sheet, which enables more inexpensive production than production of parts by machining cast steel, has been proposed, and development efforts thereof are underway. As stainless steel sheet which is used under high-temperature environments, austenitic stainless steel such as SUS310S is being used. However, in recent years, the requirements on the performance of the materials used such as the high-temperature strength and oxidation resistance have become severer and can no longer be satisfied by SUS310S.

The characteristics which are sought for materials relevant to turbocharger are high-temperature strength and creep characteristics. In the creep characteristics, a certain magnitude of deformation after a certain time is considered more important than lifetime. Further, working is essential, so a certain degree of workability is also demanded.

The invention which is disclosed in PLT 1 improves the creep strength by addition of P. However, addition of P has the problem of reducing the weldability and creep ductility. Further, there are also concerns over lowering the corrosion resistance. The invention which is disclosed in PLT 2 adds an REM, in particular Nd, in addition to P so as to improve the creep ductility and weldability. However, addition of an REM invites a rise in cost.

PLTs 3 and 4 disclose austenitic stainless steel which is excellent in heat resistance. Here, these disclose adjusting the component elements with each other to obtain steel which is excellent in heat resistance, in particular which is excellent in embrittling cracking resistance of the weld zone. However, the creep characteristics disclosed in PLTs 3 and 4 are evaluated only at 650° C. or less and are not evaluated at 800° C.

PRIOR ART DOCUMENTS

Patent Literature

PLT 1: Japanese Patent Publication No. 62-243742A
PLT 2: WO2006/106944A
PLT 3: WO2009/044796A
PLT 4: WO2009/044802A

SUMMARY OF INVENTION

Technical Problem

An object of the present invention is to improve the high-temperature strength and creep characteristics using an inexpensive system of chemical components.

Solution to Problem

The inventors of the present application engaged in studies focusing on the 800° C. high-temperature strength and creep characteristics so as to develop austenitic stainless steel which can be used as a material for automotive turbochargers.

For improvement of the high-temperature strength, in particular the creep strength, of austenitic stainless steel, the precipitation of carbides is considered effective. $M_{23}C_6$, TiC, NbC, and other carbides are utilized for improvement of the creep strength. The inventors took note of not only carbides, but also nitrides and studied in detail the effects of these on the high-temperature strength and creep strength. As a result, they discovered that the high-temperature strength and creep strength can be improved by proactively adding N and Nb, by adding V in minute amounts, further restricting the contents of Al and Ti, and manipulating the production process. The mechanism thereof has not been elucidated in detail, but the following findings were obtained.

- Fine precipitation of Nb-based carbonitrides during use of a product at a high temperature is important for improvement of the creep characteristics.
- Precipitation of Al- and Ti-based nitrides should be reduced as much as possible.
- If Nb is excessively added, Laves phases ($Fe_2Nb$) precipitate and the creep characteristics are not improved.
- If adding a fine amount of V, coarsening of the Nb-based carbonitrides is suppressed. This is effective for improvement of the creep characteristics.
- If precipitates such as undissolved carbonitrides remain in the product, these become nucleation sites of precipitation and inhibit the fine precipitation of Nb-based carbonitrides.
- The amount of residual precipitates in the product has an effect on the creep characteristics, so it is better to reduce this as much as possible.
- The amount of residual precipitates depends on the production process. In particular, the effects of the heating temperature of the hot rolling and the final annealing temperature are great.

From the above, the inventors of the present invention determined the optimal ranges of contents of Nb, V, C, N, Al, and Ti and optimized the production process so as to complete the invention which is excellent in high-temperature strength and creep characteristics. That is, the gist of the present invention is as follows:

(1) A heat-resistant austenitic stainless steel sheet comprising, by mass %,
C: 0.03% to 0.06%,
N: 0.1% to 0.3%,
Si: 1% or less,
Mn: 3% or less,
P: 0.04% or less,
S: 0.03% or less,
Ni: 5 to 12%,
Cr: 15 to 20%,
Al: 0.01% to 0.1%,
Nb: 0.05% to 0.3%,
V: 0.05% to 0.30%,
Ti: 0.03% or less,
(Nb+V)/(C+N): 2 or less and further
a balance of Fe and unavoidable impurities, and wherein an amount of precipitates mainly comprised of carbonitrides is 1% or less.

(2) The heat-resistant austenitic stainless steel sheet according to (1), further containing one or two or more of Cu: 1% or less, Mo: 3% or less, W: 3% or less, Co: 1% or less, and B: 0.01% or less.

(3) A method of production of heat-resistant austenitic stainless steel sheet according to (1) or (2), the method comprising the steps of: steelmaking; hot rolling; pickling; cold rolling; annealing; and pickling, wherein heating temperature of hot rolling is 1200° C. to 1300° C. and final annealing temperature is 1100° C. to 1200° C.

DESCRIPTION OF EMBODIMENTS

Below, the reasons for limitation of the ranges of components will be explained. All of the contents of the components have a unit of % by mass %.

C: 0.03% to 0.06%

C is an element which is effective for securing high-temperature strength and creep strength. If the amount of addition is less than 0.03%, that effect cannot be exhibited. Further, even if adding 0.1% or more, undissolved carbonitrides in the solution state merely increase.

N: 0.1% to 0.3%

N is an element which is important in the present invention. Fine carbonitrides are formed by addition of N whereby the high-temperature strength and creep strength are improved. If less than 0.1%, that effect is small. Further, addition over 0.3% requires special facilities, so the upper limit is made 0.3%

Si: 1% or less

Si is an element which is not only useful as a deoxidizing element, but is also effective for oxidation resistance. However, if excessively adding it, the toughness and ductility fall, so the upper limit is made 1%.

Mn: 3% or less

Mn, like Si, is useful as a deoxidizing element. Further, it fixes the S which is unavoidably contained in steel as sulfides and improves the hot workability. However, if excessively adding it, the mechanical characteristics deteriorate, so the upper limit is made 3%.

P: 0.04% or less

P improves the creep strength of the present invention steel, but lowers the creep ductility and the weldability. For this reason, the upper limit is made 0.04%.

S: 0.03% or less

S is contained as an unavoidable impurity in steel and remarkably lowers the hot workability. Therefore, 0.03% is made the upper limit.

Ni: 5 to 12%

Ni is an essential element for austenitic stainless steel. Further, it is an important element for securing corrosion resistance. Its suitable quantity is 5 to 12%.

Cr: 15 to 20%

Cr is an essential element for austenitic stainless steel and is an important element for securing corrosion resistance and oxidation resistance. However, if the Cr content is high, the mechanical characteristics deteriorate. Therefore, the content is made 15% to 20%.

Al: 0.01% to 0.06%

Al is useful as a deoxidizing element and is added since it enables deoxidation at a low cost. This effect appears with addition of 0.01% or more. However, Al forms AlN and causes a drop in the creep characteristics. Therefore, in the present invention, its addition is suppressed and the addition of 0.06% or less is suitable. The more preferable range of the addition is 0.03% to 0.06.

Nb: 0.05% to 0.3%

In the present invention, Nb is an essential element. By adding it simultaneously with N, it is believed that it is possible to make Nb-based carbonitrides finely precipitate and that this works to suppress their rate of growth. Due to this effect, the creep characteristics are improved. This effect is obtained by addition of 0.05% or more. However, addition of over 0.3% not only causes the carbonitrides to coarsen, but also results in the formation of $Fe_2Nb$ called Laves phases, so lowers the creep characteristics, so this is not preferable.

V: 0.05% to 0.15%

V is a necessary element in the present invention. It is an element which improves the high-temperature strength and the creep strength. Furthermore, in the present invention, together with Nb, it forms Nb-V-based carbonitrides and therefore precipitates the carbonitrides more finely and improves the creep characteristics better. This effect is obtained by addition of 0.05% or more. However, if adding over 0.30% in excess, the formation of VN causes the creep characteristics to fall, so this is not preferable.

Ti: 0.03% or less

In the present invention, Ti is an element which should be restricted. Ti easily bonds with C and N, in particular with N, to form coarse carbonitrides and suppress the formation of fine Nb-based carbonitrides and therefore causes the creep characteristics to fall, so is not preferable. If Ti is 0.03% or less, this problem can be substantially ignored, so this is made the upper limit.

Further, regarding Nb, V, C, and N, by mass %, (Nb+V)/(C+N) is preferably 2 or less. This is because if over 2, Nb and V become excessive, Lave phases etc. are formed, and the creep characteristics are lowered. Further, the lower limit is not particularly set, but if too low, C and N become excessive and there is a possibility of lowering the corrosion resistance due to precipitation of Cr-based carbides and so on, so 0.2 or more is preferable.

Cu: 1% or less

Cu is an element which finely precipitates during use thereof under a high temperature, so greatly improves the creep strength. In the present invention, it is added up to 1% as an upper limit. If over 1%, the hot workability and creep ductility and furthermore the room-temperature ductility also are lowered, so this is not preferable. If adding it, the effect is remarkably expressed with addition of 0.1% or more.

Mo: 3% or less

Mo is an element which improves the high-temperature strength and creep characteristics and can be added in accordance with need. However, if excessively adding it, the structural stability is impaired, so this is not preferable. The amount of addition is preferably 3% or less.

W: 3% or less

W, in the same way as Mo, is an element which improves the high-temperature strength and creep strength and can be added according to need. However, if excessively adding it, the structural stability is impaired, so this is not preferable. The amount of addition is preferably 3% or less.

Co: 1% or less

Co, in the same way as Mo and W, is an element which improves the high-temperature strength and creep strength and can be added according to need. However, if excessively adding it, the structural stability is impaired, so this is not preferable. The cost is also high. Therefore, the amount of addition is preferably 1% or less.

B: 0.01% or less

B is also an element which raises the high-temperature strength and creep characteristics. However, excessive addition causes the room-temperature ductility to fall, so the addition is made 0.01% or less. Preferably, it is 0.0003% to 0.0050%.

In addition to the provisions on these alloy elements, in the present invention, the amount of precipitation of the carbonitrides is also defined. Even with the same amount of alloy, the creep characteristics sometimes differ depending on the manufacturing conditions. This provision is based on the result of investigation of the causes of this. If examining the structure of steel with an inferior creep characteristics before and after a creep test, it is learned that before the creep test, there is already a certain extent of coarse precipitates present and that during the test, the coarse precipitates act as nuclei for formation of new precipitates. That is, the precipitates in the product obstruct fine precipitation at a high temperature. This is believed to be the cause for reduction of the creep characteristics. Therefore, it is important to reduce the amount of precipitation in the product. The inventors ran various tests and discovered that if the amount of precipitation in the product is 1% or less, there is no effect on the creep characteristics. Therefore, the upper limit of the amount of precipitation is made 1%. The lower limit is not particularly determined.

However, carbonitrides are formed at a relatively high temperature, so causing them to completely be dissolved is difficult. Making them less than 0.01% would place a tremendous load on the production facilities, so the amount of precipitation is preferably 0.01% or more.

Next, the method of production will be explained. The method of production of steel sheet of the present invention comprises the steps of steelmaking, hot rolling, pickling, cold rolling, annealing and pickling. In the steelmaking, steel which contains the above-mentioned essential components and components which are added in accordance with need is preferably smelted in a converter and then secondarily refined. The smelted molten steel is formed into slabs in accordance with a known casting method (continuous casting). The slabs are heated to a predetermined temperature and then hot-rolled to a predetermined thickness by continuous rolling.

After this, the hot-rolled plate is annealed, then is cold-rolled and further is final annealed and pickled to obtain the product. The cold rolling and annealing may be repeated a plurality of times. Further, other than final annealing and pickling, bright annealing may be performed to obtain the product. In this case, the annealing conditions of the bright annealing are preferably the same conditions as the final annealing.

As explained above, in the present invention, the amount of precipitation of carbonitrides is important. It is preferable to reduce the amount of precipitation in the product. However, carbonitrides are formed at a relatively high temperature, so causing them to be completely dissolved is difficult and a large burden is placed on the production facilities.

Therefore, the inventors studied in detail the amount of precipitation of the carbonitrides and the creep characteristics and production method and discovered the optimal manufacturing conditions. In the production process, the steps which are important in the present invention are the hot rolling and the final annealing. By combining the manufacturing conditions of these two steps, the amount of carbonitrides of the finished product becomes 1% or less and excellent creep characteristics are obtained. First, the heating temperature of the hot rolling is made 1200° C. to 1300° C. If less than 1200° C., undissolved carbonitrides remain in greater amounts and therefore the creep strength falls. Further, even if over 1300° C., the creep characteristics are not improved and the lifetime of the heating furnace is shortened and other problems arise, so 1300° C. is made the upper limit.

Further, the final annealing temperature is made 1100° C. to 1200° C. If less than 1100° C., a large amount of the undissolved carbonitrides which remained up until the end of the hot rolling step remains and the creep characteristics fall, so this is not preferable. Further, if over 1200° C., the danger of the strip breakage and so on increases, so the upper limit is made 1200° C.

The other steps in the production method are not particularly defined. The hot rolling conditions, hot-rolled sheet thickness and so on may be suitably selected. Further, after cold rolling and annealing, correction by temper rolling or a tension leveler may be performed. Furthermore, regarding the thickness of the product may be also selected in accordance with the required thickness of the member.

EXAMPLE 1

Steel of each of the chemical compositions which are shown in Table 1 was smelted and cast into a slab. The slab was hot-rolled to a 5 mm thick hot-rolled coil. At this time, the heating temperature was 1250° C. After that, the hot-rolled coil was annealed at an annealing temperature of 1100° C., then was pickled and was further cold-rolled to 2 mm thickness and annealed and pickled to obtain the product sheet. The final annealing temperature was 1150° C., and the annealing time was 120 seconds.

Further, regarding Steel No. 1, the heating temperature and the final annealing conditions were changed to fabricate steel sheets. These steels are the Steel 1A to Steel 1F. Except for the changed conditions, they are the same as Steel No. 1.

From the thus obtained finished sheet, tensile test piece at room temperature (JIS 13B) and a high-temperature tensile test piece were taken. Further, the total elongation which was obtained by performing the tensile test at room temperature (based on JIS Z 2241) was used as the indicator of the workability. Further, for indicators of the high temperature characteristics, a tensile test was run at 800° C. and the 0.2% yield strength and tensile strength were measured (based on JIS G 0567). Furthermore, the same test pieces were used for creep strain tests. The test temperature was made 800° C., the test time was made 300 hours, and various loads were applied to the test pieces to find the strain amounts. From these amounts, the load stress giving a strain of 1% was found. The larger the value, the better the creep characteristics can be said to be. In addition, the amount of residue extracted from the product sheet was found and was determined as the amount of precipitates.

Further, the residue was also examined by an X-ray diffraction test. It was confirmed that the residue was mainly carbonitrides.

These test results are also shown in Table 1. As clear from Table 1, the invention steels exhibit excellent high-temperature strength and creep characteristics. Further, the comparative steels are inferior in high-temperature strength or creep characteristics or have other problems and clearly are not preferable.

TABLE 1

| | Steel | Components (mass %) | | | | | | | | | | | | | (Nb + V)/ | Heating temp. | Final annealing | Amount of precipitate | Elongation at room temp. | 800° C. | | | |
|---|---|---|---|---|---|---|---|---|---|---|---|---|---|---|---|---|---|---|---|---|---|---|---|
| | No. | C | N | Si | Mn | P | S | Ni | Cr | Al | Nb | V | Ti | Others | (C + N) | (° C.) | temp. (° C.) | (%) | (%) | 0.2PS | TS | σ | Remarks |
| Inv. steel | 1 | 0.05 | 0.2 | 0.7 | 0.9 | 0.03 | 0.001 | 7.5 | 19 | 0.04 | 0.1 | 0.12 | 0.01 | | 0.88 | 1250 | 1150 | 0.6 | 50 | 140 | 260 | 15 | |
| | 2 | 0.06 | 0.15 | 0.5 | 1.5 | 0.03 | 0.001 | 9 | 17 | 0.04 | 0.2 | 0.07 | 0.02 | | 1.29 | 1250 | 1150 | 0.7 | 51 | 140 | 260 | 16 | |
| | 3 | 0.04 | 0.25 | 0.2 | 2 | 0.02 | 0.0005 | 8 | 18 | 0.05 | 0.3 | 0.14 | 0.03 | | 1.52 | 1250 | 1150 | 0.5 | 49 | 140 | 260 | 14 | |
| | 4 | 0.05 | 0.2 | 0.7 | 0.9 | 0.03 | 0.001 | 7.5 | 19 | 0.04 | 0.1 | 0.08 | 0.01 | Cu: 0.8 | 0.72 | 1250 | 1150 | 0.4 | 45 | 150 | 280 | 17 | |
| | 5 | 0.05 | 0.2 | 0.7 | 0.9 | 0.03 | 0.001 | 7.5 | 19 | 0.05 | 0.1 | 0.09 | 0.01 | Mo: 1 | 0.76 | 1250 | 1150 | 0.6 | 46 | 150 | 280 | 20 | |
| | 6 | 0.05 | 0.2 | 0.7 | 0.9 | 0.03 | 0.001 | 7.5 | 17 | 0.04 | 0.1 | 0.1 | 0.01 | W: 1 | 0.8 | 1250 | 1150 | 0.3 | 45 | 150 | 280 | 20 | |
| | 7 | 0.05 | 0.2 | 0.7 | 0.9 | 0.03 | 0.001 | 7.5 | 19 | 0.05 | 0.1 | 0.11 | 0.01 | Co: 0.5 | 0.84 | 1250 | 1150 | 0.6 | 46 | 150 | 260 | 20 | |
| | 8 | 0.05 | 0.2 | 0.7 | 0.9 | 0.03 | 0.001 | 7.5 | 16 | 0.05 | 0.1 | 0.12 | 0.01 | | 0.88 | 1250 | 1150 | 0.3 | 45 | 150 | 260 | 20 | |
| | 9 | 0.05 | 0.2 | 0.7 | 0.9 | 0.03 | 0.001 | 7.5 | 19 | 0.04 | 0.1 | 0.13 | 0.01 | B: 0.0050 | 0.92 | 1250 | 1150 | 0.5 | 46 | 145 | 270 | 18 | |
| | 10 | 0.05 | 0.2 | 0.7 | 0.9 | 0.03 | 0.001 | 7.5 | 18 | 0.04 | 0.1 | 0.08 | 0.01 | Cu: 0.4, Mo: 0.2 | 0.72 | 1250 | 1150 | 0.6 | 45 | 155 | 285 | 17 | |
| | 11 | 0.05 | 0.2 | 0.7 | 0.9 | 0.03 | 0.001 | 7.5 | 19 | 0.05 | 0.1 | 0.09 | 0.01 | Cu: 0.3. Mo: 0.3 W: 0.2, Co: 0.2 | 0.76 | 1250 | 1150 | 0.7 | 46 | 155 | 280 | 18 | |
| | 12 | 0.05 | 0.2 | 0.7 | 0.9 | 0.03 | 0.001 | 7.5 | 19 | 0.04 | 0.1 | 0.1 | 0.01 | Cu: 0.3. Mo: 0.3, Co: 0.2 | 0.8 | 1250 | 1150 | 0.8 | 45 | 160 | 270 | 18 | |
| Comp. Steel | 13 | 0.01 | 0.2 | 0.7 | 0.9 | 0.03 | 0.001 | 7.5 | 19 | 0.03 | 0.1 | 0.09 | 0.01 | | 0.90 | 1250 | 1150 | 0.5 | 51 | 120 | 240 | 8 | |
| | 14 | 0.15 | 0.2 | 0.7 | 0.9 | 0.03 | 0.001 | 7.5 | 19 | 0.03 | 0.1 | 0.09 | 0.01 | | 0.54 | 1250 | 1150 | 0.6 | 43 | 140 | 260 | 15 | |
| | 15 | 0.05 | 0.03 | 0.7 | 0.9 | 0.03 | 0.001 | 7.5 | 19 | 0.03 | 0.1 | 0.08 | 0.01 | | 2.25 | 1250 | 1150 | 0.2 | 47 | 80 | 180 | 11 | |
| | 16 | 0.05 | 0.4 | 0.7 | 0.9 | 0.03 | 0.001 | 7.5 | 19 | 0.03 | 0.1 | 0.09 | 0.01 | | 0.42 | 1250 | 1150 | 1.2 | 42 | 140 | 250 | 10 | Blowholes |
| | 17 | 0.05 | 0.2 | 1.5 | 0.9 | 0.03 | 0.001 | 7.5 | 19 | 0.03 | 0.1 | 0.09 | 0.01 | | 0.76 | 1250 | 1150 | 1.1 | 43 | 140 | 250 | 14 | |
| | 18 | 0.05 | 0.2 | 0.7 | 3.5 | 0.03 | 0.001 | 7.5 | 19 | 0.03 | 0.1 | 0.1 | 0.01 | | 0.8 | 1250 | 1150 | 0.8 | 40 | 145 | 250 | 17 | |
| | 19 | 0.05 | 0.2 | 0.7 | 0.9 | 0.7 | 0.001 | 7.5 | 19 | 0.03 | 0.1 | 0.11 | 0.01 | | 0.84 | 1250 | 1150 | 1.2 | 42 | 120 | 240 | 12 | |
| | 20 | 0.05 | 0.2 | 0.7 | 0.9 | 0.03 | 0.04 | 7.5 | 19 | 0.03 | 0.1 | 0.12 | 0.01 | | 0.88 | 1250 | 1150 | 1.3 | 48 | 120 | 240 | 12 | |
| | 21 | 0.05 | 0.2 | 0.7 | 0.9 | 0.03 | 0.001 | 4 | 19 | 0.03 | 0.1 | 0.08 | 0.01 | | 0.72 | 1250 | 1150 | 0.5 | 43 | 80 | 180 | 8 | 2-phase structure |
| | 22 | 0.05 | 0.2 | 0.7 | 0.9 | 0.03 | 0.001 | 13 | 19 | 0.03 | 0.1 | 0.09 | 0.01 | | 0.76 | 1250 | 1150 | 0.8 | 42 | 150 | 250 | 15 | |
| | 23 | 0.05 | 0.2 | 0.7 | 0.9 | 0.03 | 0.001 | 7.5 | 13 | 0.03 | 0.1 | 0.12 | 0.01 | | 0.88 | 1250 | 1150 | 0.8 | 40 | 120 | 240 | 2 | |
| | 24 | 0.05 | 0.2 | 0.7 | 0.9 | 0.03 | 0.001 | 7.5 | 24 | 0.03 | 0.1 | 0.07 | 0.01 | | 0.68 | 1250 | 1150 | 1.5 | 43 | 120 | 240 | 15 | |
| | 25 | 0.05 | 0.2 | 0.7 | 0.9 | 0.03 | 0.001 | 7.5 | 19 | 0.2 | 0.1 | 0.08 | 0.01 | | 0.72 | 1250 | 1150 | 1.3 | 46 | 130 | 250 | 8 | |
| | 26 | 0.05 | 0.2 | 0.7 | 0.9 | 0.03 | 0.001 | 7.5 | 19 | 0.03 | 0.02 | 0.09 | 0.01 | | 0.44 | 1250 | 1150 | 0.2 | 52 | 120 | 240 | 8 | |
| | 27 | 0.05 | 0.2 | 0.7 | 0.9 | 0.03 | 0.001 | 7.5 | 19 | 0.03 | 0.5 | 0.12 | 0.01 | | 2.48 | 1250 | 1150 | 1.5 | 39 | 120 | 240 | 6 | |
| | 28 | 0.05 | 0.2 | 0.7 | 0.9 | 0.03 | 0.001 | 7.5 | 19 | 0.03 | 0.1 | 0.01 | 0.01 | | 0.44 | 1250 | 1150 | 0.8 | 49 | 140 | 260 | 13 | |
| | 29 | 0.05 | 0.2 | 0.7 | 0.9 | 0.03 | 0.001 | 7.5 | 19 | 0.03 | 0.15 | 0.3 | 0.01 | | 1.80 | 1250 | 1150 | 1.5 | 39 | 120 | 240 | 20 | |
| | 30 | 0.05 | 0.2 | 0.7 | 0.9 | 0.03 | 0.001 | 7.5 | 19 | 0.03 | 0.1 | 0.12 | 0.1 | | 0.88 | 1250 | 1150 | 1.2 | 42 | 120 | 240 | 5 | |
| | 31 | 0.05 | 0.2 | 0.7 | 0.9 | 0.03 | 0.001 | 7.5 | 19 | 0.03 | 0.3 | 0.25 | 0.01 | | 2.2 | 1250 | 1150 | 1.2 | 42 | 120 | 240 | 5 | |
| | 32 | 0.05 | 0.2 | 0.7 | 0.9 | 0.03 | 0.001 | 7.5 | 19 | 0.03 | 0.1 | 0.11 | 0.01 | Cu: 1.5 | 0.84 | 1250 | 1150 | 0.8 | 38 | 150 | 290 | 18 | |
| | 33 | 0.05 | 0.2 | 0.7 | 0.9 | 0.03 | 0.001 | 7.5 | 19 | 0.03 | 0.1 | 0.12 | 0.01 | Mo: 3.5 | 0.88 | 1250 | 1150 | 0.8 | 39 | 160 | 270 | 17 | |
| | 34 | 0.05 | 0.2 | 0.7 | 0.9 | 0.03 | 0.001 | 7.5 | 19 | 0.03 | 0.1 | 0.11 | 0.01 | W: 3.5 | 0.84 | 1250 | 1150 | 0.8 | 37 | 160 | 270 | 17 | |
| | 35 | 0.05 | 0.2 | 0.7 | 0.9 | 0.03 | 0.001 | 7.5 | 19 | 0.03 | 0.1 | 0.11 | 0.01 | Co: 1.5 | 0.84 | 1250 | 1150 | 0.8 | 39 | 145 | 280 | 17 | |
| | 36 | 0.05 | 0.2 | 0.7 | 0.9 | 0.03 | 0.001 | 7.5 | 19 | 0.03 | 0.1 | 0.11 | 0.01 | B: 0.02 | 0.84 | 1250 | 1150 | 0.8 | 38 | 150 | 280 | 17 | |
| | 37 | 0.05 | 0.03 | 0.5 | 1 | 0.03 | 0.001 | 20 | 25 | 0.02 | 0.02 | 0.02 | 0.01 | | 0.50 | 1250 | 1150 | 2 | 50 | 100 | 180 | 1 | SUS310S |
| | 38 | 0.05 | 0.03 | 3.5 | 0.8 | 0.03 | 0.001 | 13.5 | 19 | 0.02 | 0.005 | 0.03 | 0.01 | | 0.44 | 1250 | 1150 | 3 | 48 | 100 | 180 | 5 | SUSXM15J1 |

TABLE 1-continued

| Steel | Components (mass %) | | | | | | | | | | | | | (Nb + V)/ | Heating temp. | Final annealing | Amount of precipitate | Elongation at room temp. | 800° C. | | | |
|---|---|---|---|---|---|---|---|---|---|---|---|---|---|---|---|---|---|---|---|---|---|---|
| No. | C | N | Si | Mn | P | S | Ni | Cr | Al | Nb | V | Ti | Others | (C + N) | (° C.) | temp. (° C.) | (%) | (%) | 0.2PS | TS | σ | Remarks |
| 1A | 0.05 | 0.2 | 0.7 | 0.9 | 0.03 | 0.001 | 7.5 | 19 | 0.03 | 0.1 | | 0.01 | | 0.40 | 1150 | 1150 | 1.5 | 42 | 140 | 260 | 8 | |
| 1B | 0.05 | 0.2 | 0.7 | 0.9 | 0.03 | 0.001 | 7.5 | 19 | 0.03 | 0.1 | | 0.01 | | 0.40 | 1350 | 1150 | 0.2 | 45 | 140 | 260 | 7 | Hot-Rolled sheet skin roughness |
| 1C | 0.05 | 0.2 | 0.7 | 0.9 | 0.03 | 0.001 | 7.5 | 19 | 0.03 | 0.1 | | 0.01 | | 0.40 | 1250 | 1050 | 1.3 | 45 | 140 | 260 | 6 | |
| 1D | 0.05 | 0.2 | 0.7 | 0.9 | 0.03 | 0.001 | 7.5 | 19 | 0.03 | 0.1 | | 0.01 | | 0.40 | 1250 | 1250 | 0.2 | 42 | 120 | 240 | 8 | Crystal grain coarsening |
| 1E | 0.05 | 0.2 | 0.7 | 0.9 | 0.03 | 0.001 | 7.5 | 19 | 0.03 | 0.1 | | 0.01 | | 0.40 | 1150 | 1050 | 1.8 | 42 | 120 | 240 | 8 | |
| 1F | 0.05 | 0.2 | 0.7 | 0.9 | 0.03 | 0.001 | 7.5 | 19 | 0.03 | 0.1 | | 0.01 | | 0.40 | 1350 | 1250 | 0.008 | 42 | 120 | 240 | 8 | Crystal grain coarsening |

INDUSTRIAL APPLICABILITY

As clear from the above explanation, according to the present invention, it is possible to provide heat-resistant stainless steel sheet which is excellent in creep characteristics. In particular, by application to an exhaust member, the contribution to society such as conservation of the environment through reduction of the cost of parts and lightening of weight is extremely great.

The invention claimed is:

1. A heat-resistant austenitic stainless steel sheet comprising, by mass %,

C: 0.03% to 0.06%,
N: 0.1% to 0.3%,
Si: 1% or less,
Mn: 3% or less,
P: 0.04% or less,
S: 0.03% or less,
Ni: 5 to 12%,
Cr: 15 to 20%,
Al: 0.04% to 0.1%,
Nb: 0.05% to 0.3%,
V: 0.05% to 0.30%,
Ti: 0.03% or less,
(Nb+V)/(C+N): 2 or less and further
a balance of Fe and unavoidable impurities, and
wherein an amount of precipitates mainly comprised of carbonitrides is 1% or less.

2. The heat-resistant austenitic stainless steel sheet according to claim 1, further comprising one or two or more of Cu: 1% or less, Mo: 3% or less, W: 3% or less, Co: 1% or less, and B: 0.01% or less.

3. A method of production of heat-resistant austenitic stainless steel sheet according to claim 1, the method comprising the steps of: steelmaking; hot rolling; pickling; cold rolling; annealing; and pickling, wherein heating temperature of hot rolling is 1200° C. to 1300° C. and final annealing temperature is 1100° C. to 1200° C.

4. A method of production of heat-resistant austenitic stainless steel sheet according to claim 2, the method comprising the steps of: steelmaking; hot rolling; pickling; cold rolling; annealing; and pickling, wherein heating temperature of hot rolling is 1200° C. to 1300° C. and final annealing temperature is 1100° C. to 1200° C.

* * * * *